US008737884B2

(12) United States Patent
Okumura et al.

(10) Patent No.: US 8,737,884 B2
(45) Date of Patent: May 27, 2014

(54) CHARGING MEMBER AND ELECTROPHOTOGRAPHIC IMAGE FORMING APPARATUS

(71) Applicant: Canon Kabushiki Kaisha, Tokyo (JP)

(72) Inventors: Yoshinobu Okumura, Machida (JP); Masaki Sunaga, Atsugi (JP); Yuichi Hashimoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 13/648,154

(22) Filed: Oct. 9, 2012

(65) Prior Publication Data

US 2013/0094884 A1 Apr. 18, 2013

(30) Foreign Application Priority Data

Oct. 12, 2011 (JP) ..... 2011-225104

(51) Int. Cl.
*G03G 15/02* (2006.01)

(52) U.S. Cl.
USPC ..... 399/175; 399/176

(58) Field of Classification Search
USPC ..... 399/175
See application file for complete search history.

(56) References Cited

U.S. PATENT DOCUMENTS

| | | | | |
|---|---|---|---|---|
| 7,082,277 | B2 * | 7/2006 | Nagatomo et al. | 399/175 |
| 7,202,586 | B2 * | 4/2007 | Okubo | 310/253 |

FOREIGN PATENT DOCUMENTS

| | | | |
|---|---|---|---|
| DE | 202011002349 | U1 * | 1/2012 |
| JP | 2007-34196 | A | 2/2007 |
| JP | 4089122 | B2 | 5/2008 |
| JP | 2008-138304 | A | 6/2008 |

OTHER PUBLICATIONS

Toth et al ("Carbon-Nanotube-Based Electrical Brush Contacts", Advanced Materials—vol. 21 Issue 20, Article published online: Jun. 3, 2009).*

* cited by examiner

*Primary Examiner* — Clayton E Laballe
*Assistant Examiner* — Leon W Rhodes, Jr.
(74) *Attorney, Agent, or Firm* — Canon U.S.A., Inc., IP Division

(57) ABSTRACT

This invention provides a charging member exhibiting high electrical charge injection efficiency.
The charging member has an electro conductive base and an electro conductive fiber, one end of which is connected to the base, in which the fiber contains a plurality of carbon nanotubes which are entangled, and the carbon nanotubes are exposed at the tip portion of the fiber.

7 Claims, 5 Drawing Sheets

CHARGING MEMBER AND ELECTROPHOTOGRAPHIC IMAGE FORMING APPARATUS

BACKGROUND OF THE INVENTION

1. Field of the Invention

The present invention relates to a charging member and an electrophotographic image forming apparatus.

2. Description of the Related Art

In the charging mechanism (charging principle) of contact charging, two kinds of charging mechanisms of (1) discharge charging mechanism and (2) direct injection charging mechanism are mixed, and the characteristics of a more dominant mechanism thereof appear.

According to the direct injection charging mechanism, charges are directly injected from a contact charging member to a body to be charged, whereby the surface of the body to be charged is charged. A charging apparatus employing a charging brush as the contact charging member is simple in terms of mechanism and is more advantageous in terms of cost than a roller charging method employing a charging roller. Therefore, the charging apparatus is being put into practical use.

However, according to the charging method including performing contact injection charging, sufficient properties in terms of injection efficiency and the like are still difficult to obtain.

In charging with a charging brush, the brush hair of the charging brush needs to be brought into uniform contact with the surface of a photosensitive member. Therefore, as fibers constituting the brush hair, electro conductive fibers in which an electro conductive filler, such as carbon, is dispersed in a base resin, such as Nylon-6, Nylon-66, Nylon-12, polyethylene terephthalate, polyethylene, and polypropylene, are used.

The electro conductive fiber is manufactured by kneading and melting resin compound pellets containing a base resin and an electro conductive filler with a desired ratio in, for example, an extruder, extruding the molten substance from a nozzle plate, and then cooling and drawing the same.

The surface of the electro conductive fiber manufactured by the above-described method almost contains an electrically insulating base resin.

Therefore, when it is attempted to charge a photosensitive member using a charging brush having the brush hair containing such electro conductive fibers, injection of charges from the charging brush to the photosensitive member is performed only when the electro conductive filler exposed to the surface of the electro conductive fiber directly contacts the photosensitive member. Therefore, there has been a problem in that the charging efficiency has been poor.

Japanese Patent No. 4089122 discloses increasing the electrical charge injection rate in a charging member which charges the surface of a body to be charged by mechanically polishing and/or cutting an electro conductive resin molded product to project a part in the longitudinal direction of a carbon nanotube out of the electro conductive resin molded product.

Moreover, Japanese Patent Laid-Open No. 2007-34196 discloses that, by the use of electro conductive fibers in which carbon nanotubes as an electro conductive filler dispersed in a base resin are almost oriented to the longitudinal direction of the fiber, a variation in the electrical resistance values of the electro conductive fibers can be reduced in a charging member for an image forming apparatus.

Moreover, Japanese Patent Laid-Open No. 2008-138304 discloses that, in order to remove a skin layer on the surface of an electro conductive fiber in which carbon nanofibers are dispersed in a polyester resin, the electro conductive fiber is immersed in an aqueous alkaline solution to perform etching treatment of dissolving a resin portion of the fiber surface to thereby reduce the contact resistance of the electro conductive fiber surface.

However, under the injection charging conditions of an increase in speed or an increase in image quality desired in an image forming apparatus, it cannot be expected to give a sufficient charging voltage to the surface of a photosensitive member for reasons described later.

In the charging member disclosed in Japanese Patent No. 4089122, all or some of the carbon nanotubes project from the charging member surface, and therefore, when charges are injected to a photosensitive member, charge are injected only from the tip portion of the carbon nanotubes directly contacting the photosensitive member. Therefore, highly efficient electrical charge injection cannot be expected.

In the electro conductive fiber disclosed in Japanese Patent Laid-Open No. 2007-34196, the direction of the carbon nanotubes dispersed in the base resin are almost uniform in the length direction of the fiber in the base resin. Therefore, when charges are injected to a photosensitive member, a skin layer having electrically high resistance present on the surface of the electro conductive fiber contacts the photosensitive member. Therefore, the injection of charges from the side surface of the electro conductive fiber is not almost performed, so that highly efficient electrical charge injection cannot be expected.

In the electro conductive fiber disclosed in Japanese Patent Laid-Open No. 2008-138304, the skin layer on the fiber surface is removed by chemical etching treatment. However, carbon nanofibers as an electro conductive filler are uniformly arranged in the length direction of the fiber in the polyester resin manufactured by melt spinning method, and therefore when charges are injected to a photosensitive member, charges are injected to the surface of the photosensitive member only in a portion of the carbon nanofibers present on the surface at the side surface of the electro conductive fiber, so that highly efficient electrical charge injection cannot be expected. Furthermore, the chemical etching treatment can be substantially performed only to polyester as a base resin, and is difficult to apply to another resin.

SUMMARY OF THE INVENTION

Then, the present invention is directed to providing a charging member exhibiting high electrical charge injection efficiency. Further, the present invention is also directed to providing an electrophotographic image forming apparatus capable of forming a high-grade electrophotographic image.

According to one aspect of the present invention, there is provided a charging member comprising an electro conductive base and an electro conductive fiber, one end of which is connected to the base, in which the fiber contains a plurality of carbon nanotubes which are entangled, and the carbon nanotubes are exposed at the tip portion of the fiber.

According to another aspect of the present invention, there is provided an electrophotographic image forming apparatus having the above-described charging member and an electrophotographic photosensitive member disposed in such a manner that the tip of the charging member contacts the same.

Further features of the present invention will become apparent from the following description of exemplary embodiments with reference to the attached drawings.

BRIEF DESCRIPTION OF THE DRAWINGS

FIG. 7A is a cross sectional view in the diameter direction of a portion which is not subjected to oxygen plasma treatment. FIG. 7B is a cross sectional view in the diameter direction of a portion which is subjected to oxygen plasma treatment.

DESCRIPTION OF THE EMBODIMENTS

Hereinafter, best modes for putting the charging member of the invention in operation are described but the invention is not limited thereto.

Figure 1:
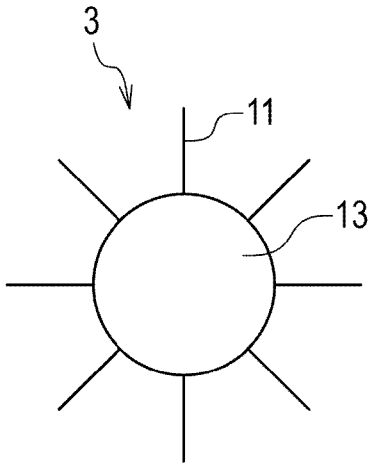
FIG. 1 is a schematic diagram of a charging member according to the invention.

FIG. 1 schematically illustrates the cross section of a charging brush 3 representing one embodiment of the charging member according to the invention. In the charging brush 3, electro conductive fibers 11 are connected to the surface of a base 13 by an electro conductive adhesive layer (not shown in FIG. 1).

Figure 7A:
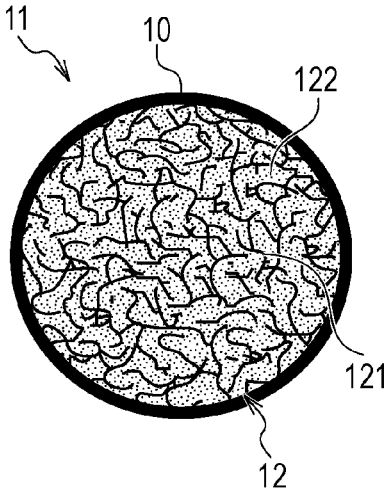
FIGS. 7A and 7B are cross sectional views in the diameter direction of the electro conductive fiber according to the invention.
Figure 7B:
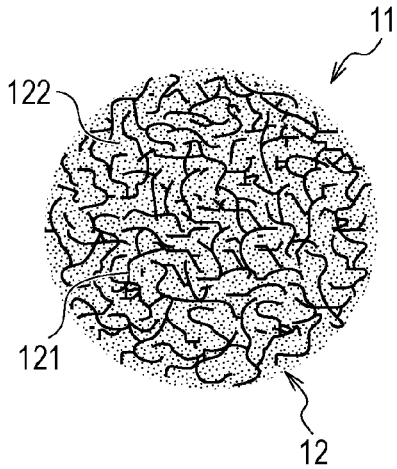

FIGS. 7A and 7B are cross sectional views in the diameter direction of one electro conductive fiber 11, in which FIG. 7A illustrates the cross section at a side close to the base, i.e., the root side of the electro conductive fiber 11 and FIG. 7B illustrates the cross section of the tip portion contacting an electrophotographic photosensitive member as a body to be charged.

In FIG. 7A, the reference numeral 12 denotes a core containing carbon nanotubes 121 and a resin 122 as a base material and having a configuration in which the carbon nanotubes 121 are entangled. The core 12 is covered with a sheath 10 containing a thermoplastic resin. In contrast, as illustrated in FIG. 7B, at the tip portion of the electro conductive fiber, the portion of the sheath 10 does not present and the carbon nanotubes constituting the core 12 are exposed.

Herein, the core 12 has a configuration in which a plurality of carbon nanotubes are entangled. As a result, it is considered that, at the tip of the electro conductive fiber, a large number of discharging points capable of forming electro conductive paths by the contact with the electrophotographic photosensitive member are present.

The carbon nanotube constituting the core is suitably one having a length L of 5 μm or lower and an aspect ratio L/D, which is a ratio of the length L to the diameter D, of 400 or lower. By adjusting the length L of the carbon nanotube to 5 μm or lower and the aspect ratio L/D to 400 or lower, also when the electro conductive fiber is formed by a melt spinning method, the carbon nanotubes are prevented from orienting in the spinning direction of the fiber, so that a core in which the carbon nanotubes are entangled can be easily obtained.

Mentioned as the carbon nanotube according to the invention, are, for example, a single-layer carbon nanotube which is a cylindrical tube containing a single graphene and a multilayer carbon nanotube in which cylindrical tubes containing two or more kinds of graphene different in the diameter are overlapped.

Mentioned as the resin constituting the base material of the electro conductive fiber are, for example, Nylon-6, Nylon-66, Nylon-12, polyethylene, polypropylene, polyethylene terephthalate, polytrimethylene terephthalate, polybutylene terephthalate, polyphenylene sulfide, and polyetheretherketone. Moreover, a mixed resin containing two or more kinds of resin may be acceptable.

The electro conductive fiber according to the invention is suitably manufactured using resin compound pellets in which a desired amount of carbon nanotubes having a length L of 5 μm or lower and the aspect ratio L/D of 400 or lower are dispersed in the above-described base resin by the use of a melt spinning method.

The resin compound pellet can be manufactured by directly kneading and melting base resin pellets and carbon nanotubes using, for example, a biaxial extruder or the like for pelletizing. In order to manufacture a resin compound pellet in which the carbon nanotubes are uniformly dispersed in the base resin, it is suitable to manufacture the resin compound pellet by freeze-pulverizing the base resin pellet, and then directly kneading and melting a base resin fine powder having a desired particle size distribution and carbon nanotubes for pelletizing.

The electro conductive fiber extruded from a nozzle plate in the molten state is cooled, a treatment agent is attached thereto, and thereafter the resultant substance is wound up at the winding-up rate of suitably 100 m/min to 10000 m/min and particularly 300 m/min to 2000 m/min.

Herein, a fiber extruded from a nozzle plate is suitably a multifilament containing a bundle of a plurality of fibers rather than a monofilament, and the number of one fiber bundle is suitably 20 to 200. As the treatment agent to be attached to the electro conductive fiber, an aqueous or non-aqueous treatment agent is applied.

The electro conductive fiber according to the invention has a core-sheath structure containing a core in which a plurality of carbon nanotubes are entangled and a sheath containing a thermoplastic resin covering the core at the root side. In contrast, at the tip portion contacting the electrophotographic photosensitive member as a body to be charged, the sheath is not provided and the carbon nanotubes contained in the core are exposed to the surface.

In order to expose the plurality of entangled carbon nanotubes at the tip portion of the electro conductive fiber which is to contact the body to be charged, a method for removing the sheath covering the core by oxygen plasma treatment is suitably used.

The oxygen plasma treatment includes introducing oxygen gas into a vacuum vessel to hold the vessel in a decompression state, and inducing oxygen plasma between the vacuum vessel and a porous metal cylindrical electrode disposed in the vacuum vessel to treat the surface of a charging brush disposed in the porous metal cylindrical electrode. By removing ions and electrons in plasma as much as possible by disposing the charging brush in the porous metal cylindrical electrode, a skin layer on the surface of the tip portion of the electro conductive fibers constituting the charging brush can be removed by oxygen atom radicals. The plasma production conditions are suitably selected depending on the apparatus configuration and the size of a substance to be treated and the high-frequency power is suitably 30 W to 300 W and the oxygen gas flow amount is suitably 30 sccm to 150 sccm.

The oxygen plasma treatment time is suitably 2 minutes or more and 10 minutes or lower. By adjusting the oxygen plasma treatment time within the above-mentioned range, the sheath covering the core can be sufficiently removed.

In the injection charging, in order to secure the convergence of potential, the time when the electrophotographic photosensitive member passes a nip contacting the charging brush is about 5 times or more the time constant including the electrical resistance of the electro conductive fibers on the peripheral surface of a charging brush member and the electrostatic capacity of the photosensitive member. For example, an amorphous silicon photosensitive member having a dielectric constant higher than that of an OPC is sometimes used at a peripheral speed of 200 mm/sec or more. In this case, more specifically, when the time constant is 2 msec or lower, the contact portion of the photosensitive member and the tip portion of the charging brush, i.e., invasion amount, is suitably several 100 μm or more and the width in the rotation direction of the electrophotographic photosensitive member of the nip contacting the electrophotographic photosensitive member suitably reaches some extent.

Therefore, the invasion amount of the brush hair defined as a value obtained by subtracting the rotation center distance of the electrophotographic photosensitive member and the charging member from the total of the radius of a common photosensitive member and the radius of a charging member is suitably 400 μm or more. Therefore, at the tip portion of the electro conductive fiber having the core-sheath structure containing a core containing a plurality of carbon nanotubes which are three dimensionally entangled and a sheath containing a thermoplastic resin covering the core, the range where the core is to be exposed is suitably at least 400 μm or more from the tip portion to the root of the electro conductive fiber.

In order to prevent destruction of the photosensitive member by current concentration to a part of the photosensitive member, the electrical resistance value per electro conductive fiber for use in the invention is suitably $1\times10^3\Omega$ or more. In order to stabilize the charging potential under the electrical charge injection conditions where the time constant is 2 msec or lower, the resistance value per electro conductive fiber is suitably set to $1\times10^{10}\Omega$ or lower as required.

Considering the above description, the resistance value per electro conductive fiber of the charging brush is suitably selected in the range of $1\times10^3\Omega$ or more and $1\times10^{10}\Omega$ or lower.

Figure 2:
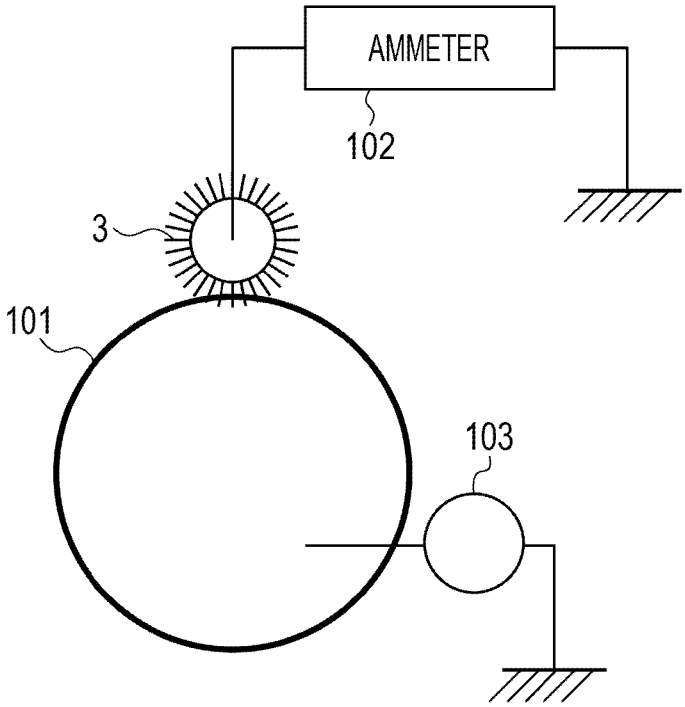
FIG. 2 is an explanatory view of a resistance measuring method of a charging brush.

A method for measuring the electrical resistance value per electro conductive fiber for use in the invention is illustrated in FIG. 2. The charging brush 3 is disposed in such a manner that the rotation axis is parallel to an aluminum cylinder 101 having a diameter of 80 mm, a voltage is applied by a high-voltage power supply 103 while rotating the charging brush 3, and then the resistance value of the brush member is calculated from the current value read by an ammeter 102. The invasion amount of the electro conductive fibers of a portion constituting the brush of the charging brush 3 is 500 μm, which was measured at a rotation rate of 100 rpm and an applied voltage of 100 V.

The region where the brush member and the aluminum cylinder contact each other is about 9 mm in the rotation direction of the brush member and 300 mm in the rotation axis direction. When the density of the electro conductive fibers is 850 fibers/mm$^2$, the measured brush member contains $2.3\times10^6$ electro conductive fibers. Therefore, the resistance value per electro conductive fiber in the state of a brush is obtained by the measured brush member resistance value$\times2.3\times10^6$.

As the base of the charging member according to the invention, electro conductive materials, such as metal and alloy, are suitably used and a base in which an insulator or a semiconductor is coated with an electro conductive metal may be acceptable. Specifically, stainless steel (SUS), Al or Al alloy, Fe or Fe alloy, Cu or Cu alloy, Ni or Ni alloy, or the like may be acceptable. Or, one in which an electro conductive rubber layer is provided on the surface of the above-mentioned metals or alloys may be acceptable.

As a method for manufacturing the charging member according to the invention includes the following two methods:

1) a woven brush manufactured by spirally winding a belt-like pile fabric, in which a bundle containing a plurality of electro conductive fibers manufactured by a melt spinning method is woven, around an electro conductive core metal shaft; and 2) an electrostatic flock brush manufactured by a so-called electrostatic flocking method including cutting electro conductive fibers manufactured by a melt spinning method into a length of about 0.5 mm to about 3 mm, and flying the same utilizing static electricity to flock the same on a base to which an electro conductive adhesive layer is applied in advance.

A method for manufacturing the woven brush is as follows. By weaving electro conductive fibers manufactured by a melt spinning method to a pile fabric, a foundation cloth having electro conductive fibers with a length of 0.5 mm to 5 mm is obtained. Next, the surface of the base is coated with an electro conductive adhesive with a thickness of 20 μm to 100 μm by, for example, a spray method. Thereafter, a surface of the foundation cloth where the electro conductive fibers are not raised is spirally wound around the surface to which the electro conductive adhesive is applied and pasted thereto, followed by drying at 60° C. to 100° C. in a drier for several hours, thereby obtaining the woven brush.

A method for manufacturing the electrostatic flock brush is as follows. Electro conductive fibers manufactured by a melt spinning method are cut into a length of about 0.5 mm to about 3 mm to thereby obtain a cut pile. Next, the surface of the base is coated with an electro conductive adhesive with a thickness of 20 μm to 100 μm by, for example, a spray method. Next, an electrode plate is disposed at a lower portion of the base while rotating the base to which an electro conductive adhesive layer is given around the axis line. Next, by placing the cut pile on the electrode plate, and then connecting the electrode plate and the base to a high-voltage power supply, the cut pile flies to be flocked to the electro conductive adhesive layer on the base.

The electro conductive adhesive layer formed on the surface of the metal core as the base is formed by applying an electro conductive adhesive in which an electro conductive filler is dispersed to an acrylic adhesive, an epoxy adhesive, and a urethane adhesive by a spray method with a thickness of 50 μm to 200 μm, and then thermally curing the same.

The resistivity value of the electro conductive adhesive layer for use in the invention is suitably in the range of $1.0\times10^2$ Ωcm or more and $1.0\times10^8$ Ωcm or lower.

Figure 6:
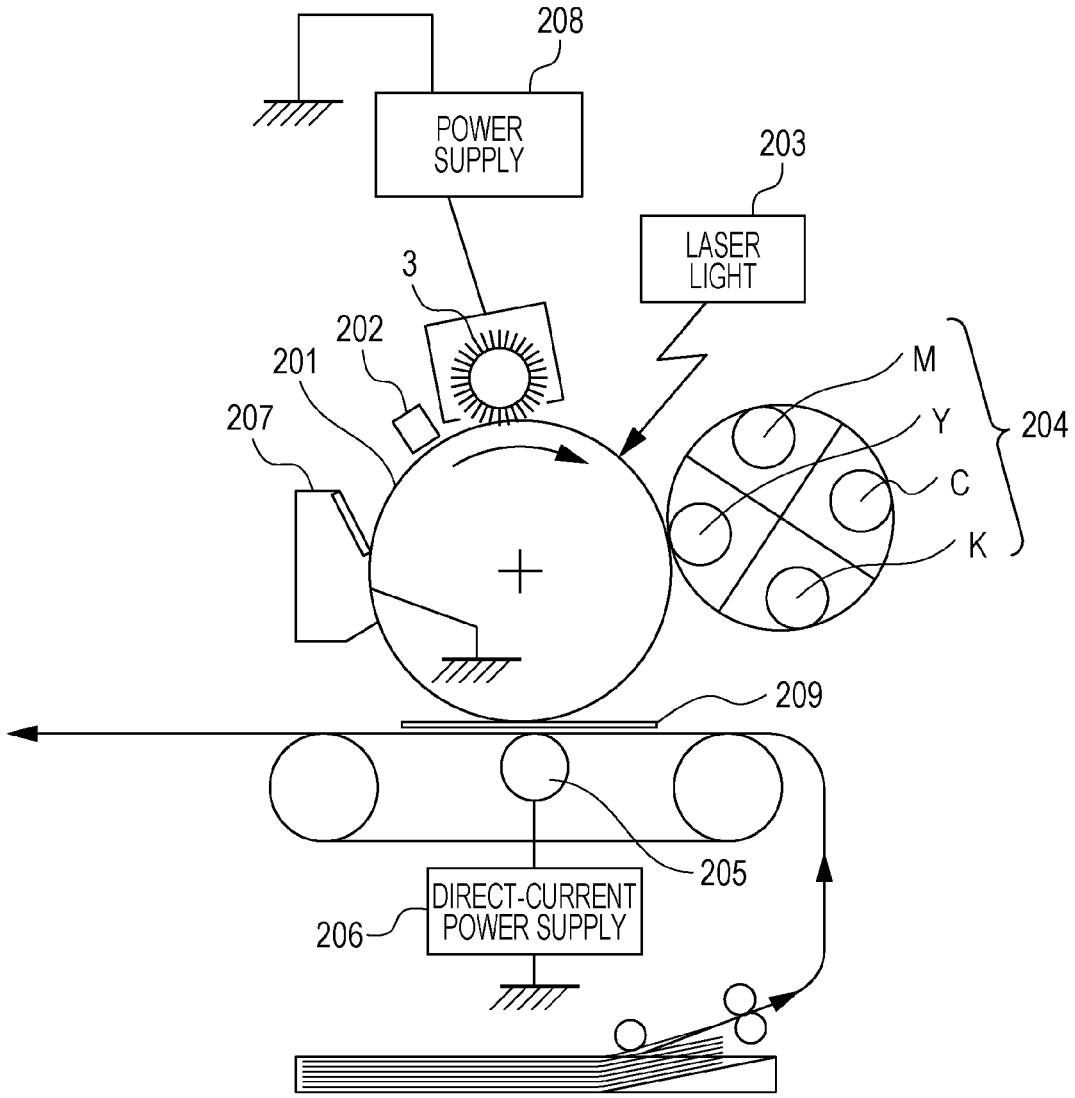
FIG. 6 is a schematic diagram of an electrophotographic image forming apparatus according to the invention.

As illustrated in FIG. 6, an electrophotographic image forming apparatus according to one embodiment of the invention has the charging member 3 containing the charging brush described above and a photosensitive member (also referred to as a photoelectro conductive drum) 201 on which a latent image is formed by being charged by the charging member.

The photosensitive member 201 is disposed in such a manner that the surface of the electro conductive fibers of the charging member 3 contacts the same.

As the photosensitive member 201, a negatively charged a-Si photoelectro conductive drum having a diameter of 80 mm is used, for example, and the rotation rate of the photosensitive member is 300 mm/sec. For a pre exposure lamp 202, an LED with a wavelength of 660 nm is used and the lamp exposes the photoelectro conductive drum surface in order to uniformly reduce the surface potential of the photoelectro conductive drum immediately before charging. For a charging apparatus, the charging member 3 having electro conductive fibers containing carbon nanotubes described above is used. Scanning exposure is performed by a laser light 203 modulated by an image signal, so that an electrostatic latent image is formed on the photoelectro conductive drum.

In a development unit 204, a development agent is applied onto development sleeves (M, Y, C, K) of 4 colors including a magnet roller, and a development bias is applied using a power supply for the development unit which is not illustrated, whereby a toner is developed on the photoelectro conductive drum. As the development agent, a negatively charged toner having a particle diameter of about 7 μm and magnetic particles for development having a particle diameter of about 35 μm are used, for example. The development sleeves rotate in the same direction as that of the photoelectro conductive drum and the peripheral speed is about 450 mm/sec. The magnetic pole of the magnet roller facing the photoelectro conductive drum is set to 90 mT and the gap between the development sleeves and the photoelectro conductive drum is set to 350 μm.

A transfer device contains an electro conductive sponge roller 205 having a diameter of 16 mm and a direct-current power supply 206, and the toner is transferred onto a member to be transferred 209 by sandwiching the member to be transferred 209 between the transfer device and the photosensitive member, and then applying a voltage having a polarity opposite to the charge polarity of the toner.

As a cleaner 207, a cleaning blade made from urethane and having a thickness of 2 mm is used, and cleaning is performed by scratching a remaining toner from the photoelectro conductive drum by the cleaning blade.

The charging brush attached to a charging device for use in the invention has an outer diameter of 20 mm and is disposed in such a manner that the rotation axis is parallel to the photosensitive member. A so-called invasion amount, which is the value obtained subtracting the distance between the rotation axes of the charging brush and the photosensitive member from a value obtained by adding the radius of the charging brush and the radius of the photosensitive member is set to 750%. By making the rotation direction of the charging brush the same as that of the photosensitive member, the charging brush and the photosensitive member move in opposite directions in the contact region of the photosensitive member and the charging brush and the rotation speed is set to 450 mm/sec to 550 mm/sec.

As the bias for charging, a direct-current voltage of −700 V is applied from a power supply 208. In this example, only a direct-current voltage is applied but an alternating voltage, such as a sine wave, may be superimposed.

According to the present invention, a charging member, such as a charging brush which contains entangled carbon nanotubes and the carbon nanotubes are exposed at the tip portion of fibers. Therefore, the contact resistance of the surface of the photosensitive member and the fiber tip portion of the charging member is reduced, so that highly efficient electrical charge injection can be achieved.

Moreover, by performing actuation operation using the electrophotographic image forming apparatus carrying such a charging brush, good image can be output.

EXAMPLES

Hereinafter, examples of the invention are described but the invention is not limited to the examples.

Example 1

Polyethylene terephthalate pellets were freeze-pulverized, and thereafter fine powder having a particle diameter of 20 μm or lower was produced by classification. Next, the polyethylene terephthalate fine powder having a particle diameter of 20 μm or lower and carbon nanotubes having a length of 5 μm or lower and an average length of 3 μm and an aspect ratio of 400 or lower were dry-blended in such a manner that the proportion of the carbon nanotubes was 5 wt %. The dry-blended materials were kneaded using a biaxial extruder and melted to thereby produce polyethylene terephthalate resin compound pellets in which the carbon nanotubes were uniformly dispersed.

Next, the pellets were dried at 140° C. for 4 hours, the pellets were introduced into a biaxial extruder, a molten substance of the pellets were discharged at a melt spinning temperature of 290° C. from a nozzle plate in the shape of a circular hole having an opening diameter of 0.3 mm and 36 pores, and then melt spinning was performed.

The obtained melt spinning thread was cooled and solidified by cooling air having an air temperature of 25° C. and an air speed of 0.5 m/sec using a cooling device (uniflow type) having a cooling length of 1 m, an oil agent (Effective ingredient concentration of 10 wt %) was attached thereto, and the resultant yarn was wound up at 1000 m/min, thereby producing an undrawn multifilament yarn having a fiber diameter of 42 μm.

The obtained undrawn multifilament yarn was thermally drawn at a temperature of 150° C. in such a manner that the draw ratio was twice to thereby produce a multifilament yarn containing 36 electro conductive fibers having a diameter of 30 μm.

One electro conductive fiber having a length 5 cm was cut out from the obtained multifilament yarn, disposed in such a manner that the entire fiber surface was exposed to plasma, and then subjected to oxygen plasma treatment. The resistance value of the electro conductive fiber after the oxygen plasma treatment was $3\times10^{7}\Omega$.

Figure 8:
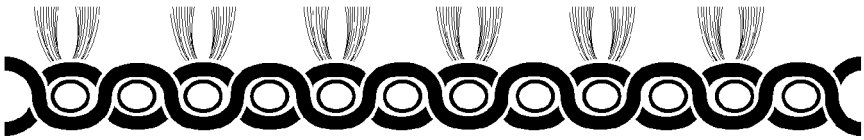
FIG. 8 is a schematic cross sectional view of a ribbon-like pile fabric for use in the charging brush according to the invention.

Next, using the multifilament yarn produced above, a ribbon-like pile fabric having a width of 15 mm was produced as illustrated in FIG. 8. Next, in a state where the ribbon-like pile fabric was wound around an aluminum pipe, the aluminum pipe was disposed in a porous metal cylindrical electrode in a vacuum vessel in such a manner that only both ends of the aluminum pipe were supported, and then oxygen plasma treatment was performed.

Figure 3:
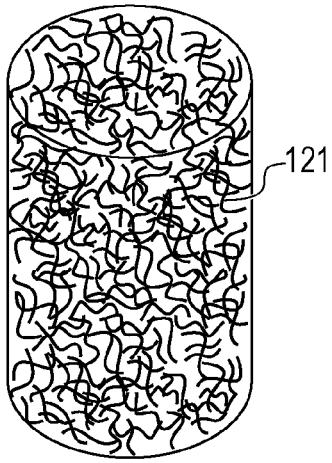
FIG. 3 is a schematic view of a dispersion state of carbon nanotubes present on the surface and the cross section near the tip portion of an electro conductive fiber according to EXAMPLE 1.

One electro conductive fiber was extracted from the ribbon-like pile fabric after the oxygen plasma treatment, and SEM observation of the surface and the cross section of the plasma treated tip portion of the electro conductive fiber was performed. From the SEM observation results, the dispersion state of the carbon nanotubes 121 as the constituent ingredients of the core of the electro conductive fiber is schematically illustrated in FIG. 3. It was found that the carbon nanotubes 121 were three dimensionally entangled to constitute the network structure on the surface of and in a core portion of the electro conductive fiber as illustrated in FIG. 3.

Separately, one electro conductive fiber was extracted from the ribbon-like pile fabric after the oxygen plasma treatment, and then SEM observation of the electro conductive fiber surface at the base side of the pile fabric opposite to the plasma treated side (side contacting the aluminum pipe) was performed. As a result, the carbon nanotubes were not observed. This means that a skin layer was present on the surface which was not subjected to the plasma treatment in the electro conductive fiber in which the carbon nanotubes were dispersed.

Example 2

Polyphenylene sulfide pellets were freeze-pulverized, and thereafter fine powder of having a particle diameter of 20 μm or lower was produced by classification. Next, the polyphenylene sulfide fine powder having a particle diameter of 20 μm or lower and carbon nanotubes having a length of 5 μm or lower and an average length of 3 μm and an aspect ratio of 400 or lower were dry-blended in such a manner that the proportion of the carbon nanotubes was 4.5 wt %. The dry-blended materials were kneaded using a biaxial extruder and melted to thereby produce polyphenylene sulfide resin compound pellets in which the carbon nanotubes were uniformly dispersed. Next, using the pellets, a multifilament yarn containing 36 electro conductive fibers having a diameter of 28 μm was produced in the same manner as in EXAMPLE 1.

One electro conductive fiber having a length 5 cm was cut out from the obtained multifilament yarn, and then the entire electro conductive fiber surface was subjected to oxygen plasma treatment. The resistance value of the electro conductive fiber after the oxygen plasma treatment was $8\times10^7\Omega$.

Next, using the multifilament yarn produced above, a ribbon-like pile fabric having a width of 15 mm was produced in the same manner as in EXAMPLE 1, and then oxygen plasma treatment was performed in a state where the ribbon-like pile fabric was wound around an aluminum pipe.

One electro conductive fiber was extracted from the ribbon-like pile fabric after the oxygen plasma treatment, and SEM observation of the surface and the cross section of the plasma treated tip portion of the electro conductive fiber was performed. From the SEM observation results, it was found that the dispersion state of the carbon nanotubes as the constituent ingredients of the core of the electro conductive fiber constitutes the network structure in which the carbon nanotubes 121 were three dimensionally entangled on the surface of and in the core of the electro conductive fiber similarly as in FIG. 3.

Comparative Example 1

Polyethylene terephthalate resin compound pellets in which carbon nanotubes having an average length of 10 μm and an average aspect ratio of 150 were dispersed in a polyethylene terephthalate resin in a proportion of 5 wt % were produced in the same manner as in EXAMPLE 1.

Next, using the pellets, a multifilament yarn containing 36 electro conductive fibers having a diameter of 30 μm was produced in the same manner as in EXAMPLE 1.

Figure 4:
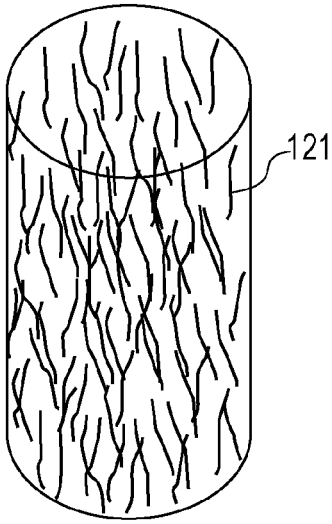
FIG. 4 is a schematic view of a dispersion state of carbon nanotubes in the core of an electro conductive fiber according to COMPARATIVE EXAMPLE 1.

One electro conductive fiber having a length 5 cm was cut out from the obtained multifilament yarn, and then the entire electro conductive fiber surface was subjected to oxygen plasma treatment. SEM observation of the surface and the cross section of the core of the electro conductive fiber after the oxygen plasma treatment was performed. From the SEM observation results, the dispersion state of the carbon nanotubes 121 dispersed in the core of the electro conductive fiber is schematically illustrated in FIG. 4. As illustrated in FIG. 4, the carbon nanotubes 121 were uniformly oriented in the length direction of the fiber and were not entangled in the core of the electro conductive fiber.

Comparative Example 2

Polyethylene terephthalate pellets were freeze-pulverized, and thereafter fine powder having a particle diameter of 20 μm or lower was produced by classification. Next, the polyethylene terephthalate fine powder having a particle diameter of 20 μm or lower and carbon nanofibers having an average length of 15 μm and an aspect ratio of 100 were dry-blended in such a manner that the proportion of the carbon nanofibers was 5 wt %. The dry-blended materials were kneaded using a biaxial extruder and melted to thereby produce polyethylene terephthalate resin compound pellets in which the carbon nanofibers were uniformly dispersed.

Next, using the pellets, a multifilament yarn containing 36 electro conductive fibers having a diameter of 30 μm was produced in the same manner as in EXAMPLE 1.

Figure 5:
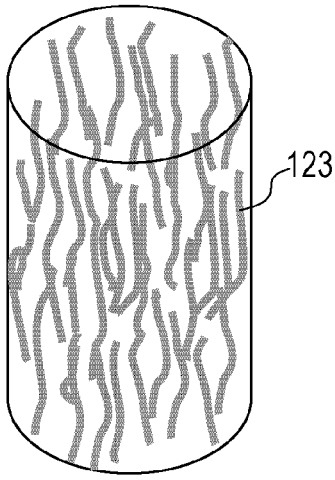
FIG. 5 is a schematic view of a dispersion state of carbon nanotubes in the core of an electro conductive fiber according to COMPARATIVE EXAMPLE 2.

One electro conductive fiber having a length 5 cm was cut out from the obtained multifilament, and then the entire electro conductive fiber surface was subjected to oxygen plasma treatment. SEM observation of the surface and the cross section of the electro conductive fiber after the oxygen plasma treatment was performed. From the SEM observation results, the dispersion state of carbon nanofibers 123 dispersed in the core of the electro conductive fiber is schematically illustrated in FIG. 5. As illustrated in FIG. 5, the carbon nanofibers 123 were uniformly oriented in the length direction of the fiber and were not entangled.

Example 3

Polyethylene terephthalate resin compound pellets in which carbon nanotubes having a length of 5 μm or lower and an average length of 3 μm and an aspect ratio of 400 or lower were uniformly dispersed in a polyethylene terephthalate resin were produced in the same manner as in EXAMPLE 1.

Using the pellets, a multifilament yarn containing 36 electro conductive fibers having a diameter of 24 μm was produced in the same manner as in EXAMPLE 1.

A ribbon-like pile fabric having a width of 15 mm as illustrated in FIG. 8 was produced using the obtained multifilament yarn. The ribbon-like pile fabric was wound around a stainless steel base, the base was disposed in a porous metal cylindrical electrode in a vacuum vessel in such a manner that only both ends of the base were supported, and then oxygen plasma treatment was performed. By performing final finishing processing of the surface after the plasma treatment, a charging brush having an outer diameter of 20 mm was produced. The electro conductive fiber density of the charging brush surface was 200 kF/inch$^2$.

One electro conductive fiber was extracted from the charging brush, and SEM observation of the surface and the cross section was performed. As a result, it was confirmed that the carbon nanotubes were three dimensionally entangled to constitute the network structure on the surface of and in the electro conductive fiber as illustrated in FIG. 3 at the tip portion of the electro conductive fiber.

Figure 9:
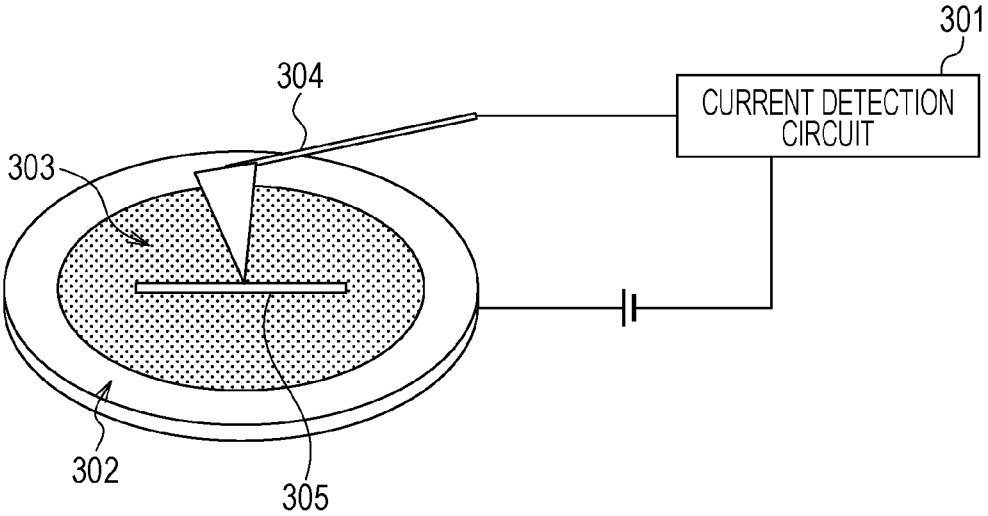
FIG. 9 is a schematic diagram of a scanning probe microscopy according to the invention.

The discharge properties of the surface of a portion subjected to the oxygen plasma treatment at the tip of the electro conductive fiber were evaluated by the following method. More specifically, a bias voltage of 10 V was applied to an STM probe 304 using a scanning probe microscopy illustrated in FIG. 9, the STM probe was brought into contact with the surface of an electro conductive fiber 305 placed on an electro conductive sheet 303 placed on an aluminum sample stand 302, and then the value of a current flowing into the STM probe was measured, while scanning a 5 μm×5 μm region, throughout the scanning region. The reference numeral 301 represents a current detection circuit in FIG. 9. As a result, it was found that an electro conductive path was formed between the portion and the electrode in an about 75% region on the basis of the entire surface area of the measurement portion of the oxygen plasma treated portion.

Next, the charging brush was placed on a copying machine illustrated in FIG. 6, and the invasion amount into the photosensitive member of the charging brush was set to 1 mm. The rotation speed of the charging brush was set to 500 mm/sec, and then a direct-current voltage of −700 V was applied to the charging brush to form an electrophotographic image. As a result, a good image was obtained in which the size of the meshes of a half-tone portion was uniform. More specifically, it was confirmed that the photosensitive member was uniformly and favorably charged.

Comparative Example 3

A multifilament yarn containing 36 electro conductive fibers was produced in the same manner as in EXAMPLE 3, and then a ribbon-like pile fabric having a width of 15 mm was produced.

Next, the ribbon-like pile fabric was wound around a SUS base, and then final finish processing of the surface was performed, thereby producing a charging brush having an outer diameter of 20 mm. The electro conductive fiber density of the charging brush surface was 200 kF/inch$^2$.

The discharge properties of the surface of the electro conductive fiber were evaluated by the following method. More specifically, the value of a current of the electro conductive fiber surface throughout a scanning region was measured using a scanning probe microscopy in the same manner as in EXAMPLE 3. As a result, it was found that an electro conductive path was formed between the portion and the electrode only in an about 30% region on the basis of the entire surface area of the measurement portion of the electro conductive fiber.

Next, the charging brush was placed on a copying machine illustrated in FIG. 6 in the same manner as in EXAMPLE 3, and the invasion amount into the photosensitive member of the charging brush was set to 1 mm. The rotation speed of the charging brush was set to 500 mm/sec, and then a direct-current voltage of −700 V was applied to the charging brush. As a result, an image was output in which the white portion of paper was covered with a toner in the shape of stripes along the movement direction of the paper. Moreover, a coarse image was obtained in which the size of the meshes of a half-tone portion was not uniform.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-225104 filed Oct. 12, 2011, which is hereby incorporated by reference herein in its entirety.

What is claimed is:

1. A charging member, comprising:

an electro conductive base; and an electro conductive fiber, one end of which is connected to the base, wherein:

said fiber contains a plurality of carbon nanotubes which are entangled, and said carbon nanotubes are exposed at a tip portion of said fiber.

2. The charging member according to claim 1, wherein said carbon nanotube has a length of 5 μm or lower and an aspect ratio of 400 or lower.

3. The charging member according to claim 1, wherein said fiber contains resin as a base material.

4. The charging member according to claim 1, wherein said fiber has, at a root portion thereof, a core-sheath structure having:

a core containing said entangled carbon nanotubes and resin as a base material; and a sheath containing a resin covering said core, and said fiber has, at the tip portion of the fiber, said sheath is not provided and said entangled carbon nanotubes contained in the core are exposed.

5. The charging member according to claim 3, wherein said resin as a base material, is at least one selected from the group consisting of nylon, polyethylene, polypropylene, polyethylene terephthalate, polytrimethylene terephthalate, polybutylene terephthalate, polyphenylene sulfide, and polyetheretherketone.

6. The charging member according to claim 1, wherein an electrical resistance value of said electro conductive fiber is $1\times10^3\Omega$ or more and $1\times10^{10}\Omega$ or lower.

7. An electrophotographic image forming apparatus, comprising:

the charging member according to claim 1; and an electrophotographic photosensitive member disposed in such a manner that a tip of the charging member contacts the electrophotographic photosensitive member.

* * * * *